United States Patent [19]

Quinn et al.

[11] Patent Number: 4,662,857

[45] Date of Patent: May 5, 1987

[54] ARTICULATED SOFT DOLL CONSTRUCTION ASSEMBLY

[75] Inventors: Gregory F. Quinn; Virgil W. Wulff, both of Fullerton; Robert F. Schroeder, Long Beach, all of Calif.

[73] Assignee: Mattel, Inc., Hawthorne, Calif.

[21] Appl. No.: 781,299

[22] Filed: Sep. 27, 1985

[51] Int. Cl.[4] ..... A63H 3/02; A63H 3/46

[52] U.S. Cl. ..... 446/371; 446/384

[58] Field of Search ..... 446/371, 370, 384, 391, 446/376, 383, 381, 369

[56] References Cited

U.S. PATENT DOCUMENTS

| | | | |
|---|---|---|---|
| 1,456,422 | 5/1923 | Cabana | 446/381 |
| 1,709,432 | 4/1929 | Hill | 446/371 |
| 1,880,109 | 9/1932 | Sanders . | |
| 2,021,115 | 11/1935 | Jackson | 446/383 |
| 2,089,376 | 8/1937 | Jacobson . | |
| 3,866,350 | 2/1975 | Goldfarb et al. . | |
| 3,939,604 | 2/1976 | Nishizawa . | |
| 4,268,991 | 5/1981 | Cotey et al. . | |

FOREIGN PATENT DOCUMENTS

| | | | |
|---|---|---|---|
| 398914 | 2/1925 | Fed. Rep. of Germany | 446/383 |

*Primary Examiner*—Mickey Yu

*Attorney, Agent, or Firm*—Ronald Goldman; Melvin A. Klein; Daniel F. Sullivan

[57] ABSTRACT

An articulated soft doll construction in which a soft skin covers a soft doll head and a soft skin covers a soft torso in which the head is universally moveable relative to the torso. The torso has a first skin cover covering a fiber filler material. The torso and first skin cover are formed with an opening in which a neck connecting member is received. A second soft skin cover is used to cover a soft head that is filled with fiber material. A neck plug is received through an opening in the head and second soft skin cover. Disposed inside a neck plug is a ball and socket assembly in which the ball is connected to a spindle member that extends into the torso and is received by the neck connecting member for engagement therewith. A collar member is received inside the neck plug for retaining the second soft skin cover around the head. A remaining member is received by the neck connecting member to retain the first soft skin cover. The ball and socket assembly enables universal movement of the head relative to the torso of the doll while the first and second soft skin covers are retained.

6 Claims, 3 Drawing Figures

ARTICULATED SOFT DOLL CONSTRUCTION ASSEMBLY

BACKGROUND OF THE INVENTION

1. Technical Field

This invention relates generally to dolls and more particularly to a soft articulated doll in which a soft skin covers a hollow fiber filled torso and head and also provides an assembly providing universal movement of the head relative to the torso.

2. Prior Art Patents

U.S. Pat. No. 1,880,109 to Sanders issued Sept. 2, 1932 shows a doll having a stuffed fabric body and hollow limb members connected to the body in which the limb members can be bent and twisted freely in all directions.

U.S. Pat. No. 2,089,376 to Jacobson issued Aug. 10, 1937 shows an inanimate figure and method of making same using a gum in the nature of a chicle and an insert filler.

U.S. Pat. No. 3,866,350 to Goldfarb et al issued Feb. 18, 1975 shows a soft doll construction having a resilient three dimensional head mounted on support means for universal movement.

U.S. Pat. No. 3,939,604 to Nishizawa issued Feb. 24, 1976 shows an exchangable dressing doll which has freedom to flex at optional parts of the body corresponding to the articulations of the limb, trunk, neck or the like.

U.S. Pat. No. 4,268,991 to Cotey et al issued May 26, 1981 shows a soft flexable articulated doll in which soft flexible appendages are connected to a skeleton frame by means of a ball and socket assembly.

SUMMARY OF THE INVENTION

It is a principle object of the present invention to provide a soft articulated doll which has a fabric skin covering for the torso and the head which enables universal movement of the head relative to the torso.

A further object of the present invention is to provide an improved articulated soft doll construction with moveable head which is safe as a toy for children but that is relatively inexpensive.

A further object of the present invention is to provide a soft articulated doll that enables children to fully enjoy posing of the head relative to the torso of the doll by a new and improved construction.

The invention briefly stated may be accomplished by providing a torso that has a first fabric cover filled with a suitable filler material and that has an opening formed in the torso and cover for receiving a neck connecting member. A head made of a second soft fabric cover filled with a suitable filler material has an opening formed in the head and fabric cover for receiving a neck plug. The neck plug receives a ball and socket assembly in which a spindle member protrudes from the ball and socket assembly into an opening formed in the neck connecting member for engagement therewith. The fabric covering the head is retained by a collar member coaxial with and received by the neck plug. A retaining member is received by a neck connecting member for retaining the first soft skin cover surrounding the torso. In this manner a soft doll with a soft torso and head that are covered by a fabric skin is provided in which the head and torso can have universal relative movement thereto for posing of the doll head in different positions.

BRIEF DESCRIPTION OF THE DRAWINGS

Figure 1:
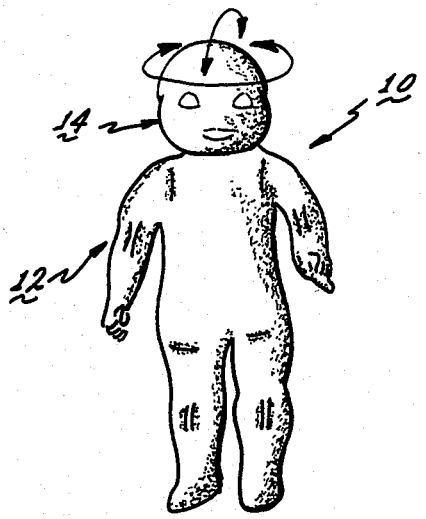
FIG. 1 is a perspective of the soft articulated doll figure according to the invention.
Figure 2:
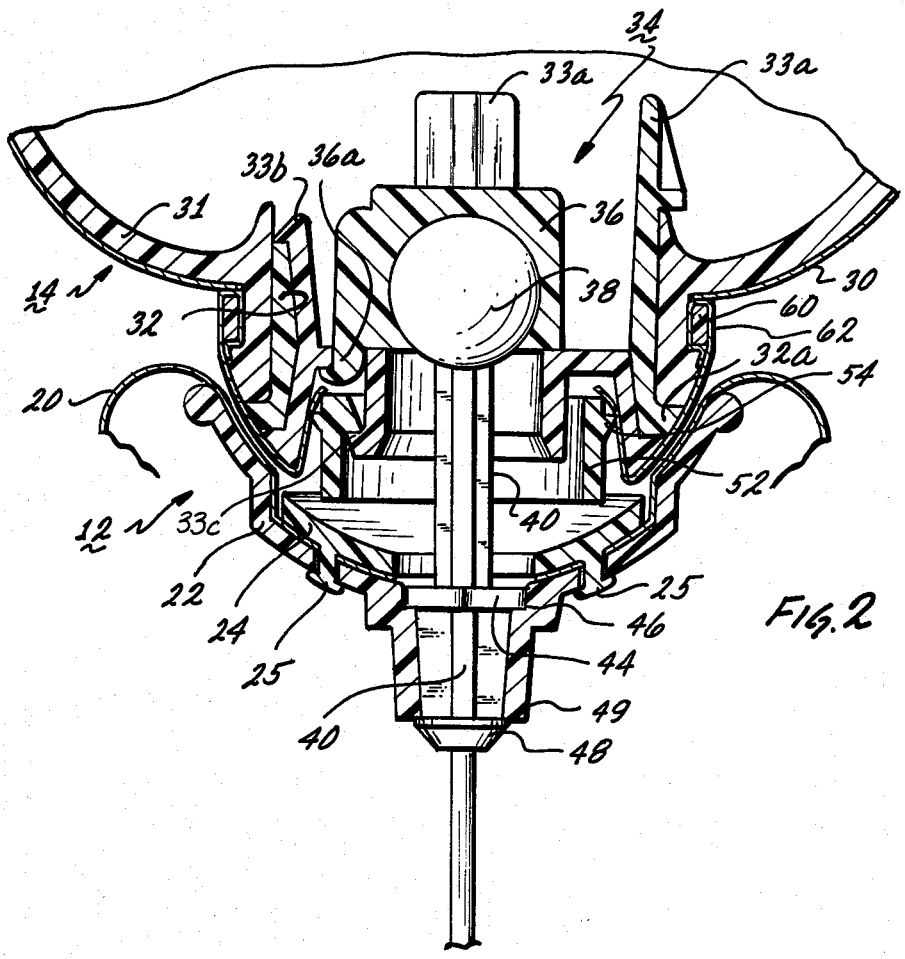
FIG. 2 is an enlarged side sectional view of the head and upper torso of the doll according to a preferred embodiment of the invention.
Figure 3:
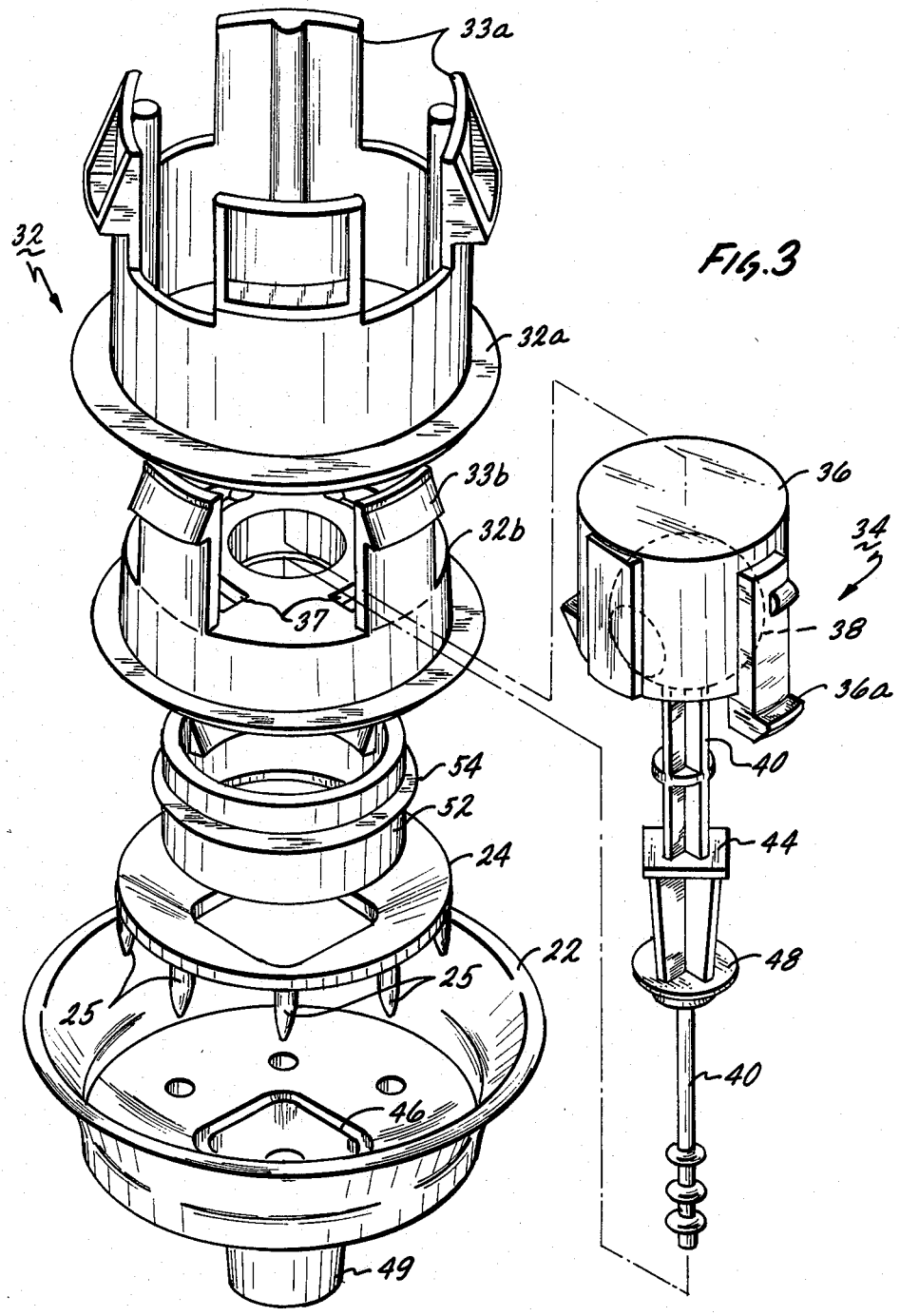
FIG. 3 is an explosed view of the assembly connected the head to upper torso, illustrating certain details thereof.

FIG. 1 shows a soft articulated doll 10 having a torso 12 and a head 14 and other appendages. Referring now to FIG. 2 and FIG. 3 the torso 12 has a soft fabric cover 20 that is filled with any suitable material made of fiber or foam or the like to provide a soft body and the feel and texture of a soft or rag type doll. In the vicinity of the neck of the torso is an opening that is formed in the torso 12 and in the fabric cover 20. Received in this opening is a neck connecting member 22 over which the fabric cover 20 is extended and then retained by a fabric containing member 24. Retaining member 24 has protrusion 25 which are cold formed to hold assembly together (FIG. 2). Overlying the neck connecting member 22 is head 14 of the doll which has a similar soft fabric cover 30. Head 14 has a skull 31 made of relatively soft material. If desired skull 31 is filled with a fiber or foam material or the like. Disposed inside of the head 14 is a neck plug assembly 32 including neck plug members **32*a* and 32*b*. Neck plug members 32*a* and 32*b* are formed with detent members 33*a* and 33*b*, repespectively, to facilitate assembly of the head to the torso. Disposed inside of the neck plug assembly 32 is a ball and socket assembly 34 having a socket member 36 which fits around a ball member 38. Socket member 36 is formed with detent members 36*a* facititate assembly within openings 37 formed in member 32*b*. Ball and socket assembly 34 is made by a plastic insert mold for universal movement in a snug fit. The ball member 38 has a spindle portion 40 that extends through the neck connecting member 22 and an opening formed therein into the torso 12. The spindle portion 40 has a first shoulder portion 44 that has a rectangular shape that is received in a rectangular opening 46 formed in the neck connecting member 22. The spindle portion 40 has a second shoulder portion 48 that has a circular shape that engages a base portion 49** of the neck connecting member.

It will be appreciated that due to the unique construction of the head including ball and socket assembly 34 that the head 14 may be moved in universal like movement for posing of the head relative to the torso. By virtue this construction the head may be rotated or pivoted relative to the torso without movement being imparted to the torso.

A collar member 52 is received in the neck plug assembly 32 in coaxial alignment therewith on detent members **33*c* (FIG. 2), which are formed on the assembly. Collar member 52 has teeth 54 along the periphery thereof for retaining the fabric cover 30 that is extended around the head 14 of the doll. Retaining member 24 is inserted in overlying relation to the neck connecting member for engagement of the fabric cover 20 extending around the torso. A flexible retaining member 60 is positioned around the head 14 within a channel 62 for drawing the skin cover 30** tightly around the head.

Retaining member 60 is received in an opening in the head.

It will now be appreciated that due to this unique construction that a soft doll is provided with an articulated head that may be posed in different directions and fully rotated to the amusement of a child. At the same time the construction is soft and resilient and particularly desirable for a doll to be held and cuddled by a child.

We claim:

1. An articulated soft doll in which the head is pivotable and rotatable to effect posing thereof comprising;

a soft torso having a soft cover, said torso and cover having an opening formed therein;

a neck connecting member received by the torso through the opening in said torso and cover, said connecting member having a rectangular opening therein;

a neck plug assembly positioned within said neck connecting member;

a soft head having a cover associated therewith, said head and said head associated cover having an opening formed therein for receiving the neck plug assembly;

a ball and socket assembly received by said neck plug assembly, said ball and socket assembly having an elongated spindle member extending through the opening formed in said neck connecting member, said spindle member having a shoulder portion rectangular in shape for engagement with the rectangular opening formed in the neck connecting member whereby universal movement can be applied to said head of the doll for different poses relative to the torso in a soft doll construction with soft covers.

2. A doll according to claim 1 wherein a collar is received by said neck plug assembly, said collar having teeth protruding along the periphery thereof.

3. A doll according to claim 2 including a pull string encircling the head in the vicinity of said neck plug assembly.

4. A doll according to claim 1 wherein said spindle member has a second shoulder portion spaced from said first shoulder portion and said second shoulder has a circular shape extending below said neck connecting member in engagment therewith.

5. A doll according to claim 1 wherein said ball and socket assembly is insert molded to provide a snug fit.

6. A doll according to claim 1 wherein said soft covers are made of a fabric and said head and torso are filled with a fiber material.

* * * * *